US005284262A

United States Patent [19]

O''Nan

[11] Patent Number: 5,284,262

[45] Date of Patent: Feb. 8, 1994

[54] PROGRAMMABLE SAFETY CONTAINER AND CLOSURE MEANS

[76] Inventor: Rocky K. K. O''Nan, 818 King St., #1403, Honolulu, Hi. 96813

[21] Appl. No.: 978,772

[22] Filed: Nov. 19, 1992

[51] Int. Cl.[5] ..... B65D 55/02

[52] U.S. Cl. ..... 215/206; 215/221; 220/253; 70/232

[58] Field of Search ..... 215/206, 217, 221, 230; 206/1.5; 220/253; 222/153; 70/63, 77, 158, 163, 165, 167, 232, 286, 287, 288, 329, 330, 331, 332

[56] References Cited

U.S. PATENT DOCUMENTS 3,313,441 4/1967 Fadden ..... 215/206

3,843,007 10/1974 Meyer ..... 215/206

*Primary Examiner*—Stephen P. Garbe
*Assistant Examiner*—Nova Stucker
*Attorney, Agent, or Firm*—Robert M. Sperry

[57] ABSTRACT

Improved safety devices comprising a container; a closure means for the container having a plurality of annular bands rotatably mounted on the closure means, each of these bands being formed with a plurality of elements which are selectably removable for programming the closure means and which must be aligned in the selected manner in order to gain access to the contents of the container; and indicia carried by the container for indicating when the selected elements are aligned in the selected manner.

6 Claims, 2 Drawing Sheets

PROGRAMMABLE SAFETY CONTAINER AND CLOSURE MEANS

BACKGROUND

1. Field of the Invention

This invention relates to closure means and is particularly directed to controllably openable closure means for safely locking containers for liquid and solid medicines and other dangerous substances to prevent accidental or undesired access to the contents of such containers.

2. Prior Art

Although accidental poisonings have decreased since the enactment of the Poison Prevention Packaging Act of 1971, a tragic and unacceptable mortality rate still exists, indicating that even the latest safety packaging is ineffective. Statistics from the Consumer Product Safety Commission and the American Association Of Poison Control Centers clearly identify children, 5 years of age and under, and the elderly as the two groups most effected by the child-resistant cap issue. Conventionally, these safety caps have required multiple actions to accomplish removal of the caps. Thus, for example, some prior art safety caps have required the user to press inwardly on a portion of the cap while simultaneously twisting the cap to achieve removal of the cap. Other prior art safety caps have required the user to twist the cap in a first direction, lift it slightly and, then, twist it in a second direction in order to remove the cap. Numerous other multiple action safety caps have been proposed. However, many of these have been so complicated to remove that even authorized persons have had difficulty in removing the caps. Other so-called safety caps have been ineffective and can be removed by anyone with little or no effort. Still other prior art safety caps have been complex devices which have been prohibitively expensive to manufacture and purchase. Furthermore, most of the prior art safety caps have been useful with either solid or liquid medications, but have not been adaptable for interchangeable use. Thus, none of the prior art safety caps have been entirely satisfactory.

BRIEF SUMMARY AND OBJECTS OF INVENTION

These disadvantages of the prior art are overcome with the present invention and improved safety devices are provided which are programmable by the user, a critical feature not found in other cap designs, and which is simple and inexpensive to manufacture, purchase and use, yet which provides positive locking of the contents against inadvertent or unauthorized access and which can be adapted for use with either solid or liquid substances.

These advantages of the present invention are preferably attained by providing improved safety devices comprising a container; a closure means for the container having a plurality of annular bands rotatably mounted on the closure means, each of these bands being formed with a plurality of elements which are selectably removable for programming the closure means and which must be aligned in the selected manner in order to gain access to the contents of the container; and indicia carried by the container for indicating when the selected elements are aligned in the selected manner.

Accordingly, it is an object of the present invention to provide improved safety device.

Another object of the present invention is to provide improved safety containers which are inexpensive to manufacture and purchase and which are simple to operate.

An additional object of the present invention is to provide improved safety containers which are programmable by the user, thereby making it unlike any prior art.

A further object of the present invention is to provide improved safety containers which can be adapted for use with either solid or liquid substances.

Another object of the present invention is to provide improved safety containers which are simple to program and operate, yet which provide positive locking of the contents against inadvertent or unauthorized access.

A specific object of the present invention is to provide improved safety devices comprising a container; a closure means for the container having a plurality of annular bands rotatably mounted on the closure, each of these bands being formed with a plurality of elements which are selectably removable for programming the closure means and which must be aligned in the selected manner in order to gain access to the contents of the container; and indicia carried by the container for indicating when the selected elements are aligned in the selected manner.

These and other objects and features of the present invention will be apparent from the following detailed description, taken with reference to the figures of the accompanying drawing.

DETAILED DESCRIPTION OF THE INVENTION

Figure 1:
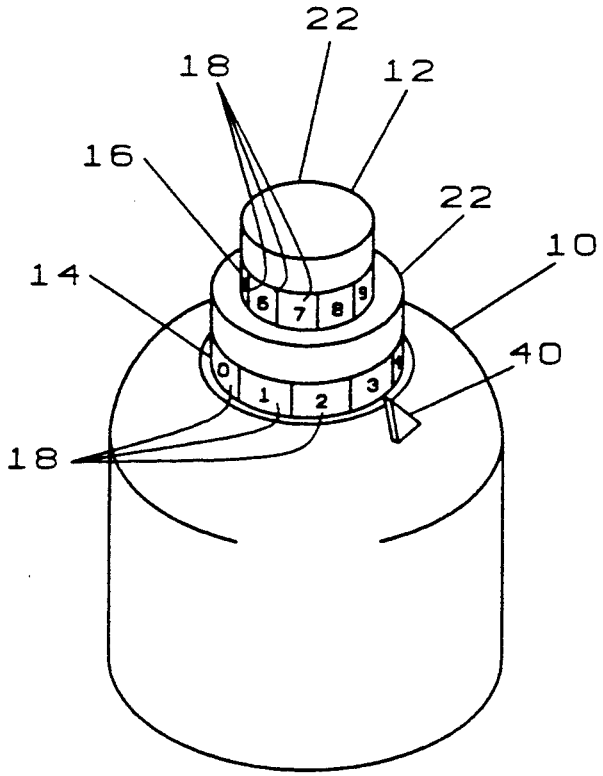
FIG. 1 is a partial side view of a safety container having a cap for dispensing solids embodying the present invention.
Figure 2:
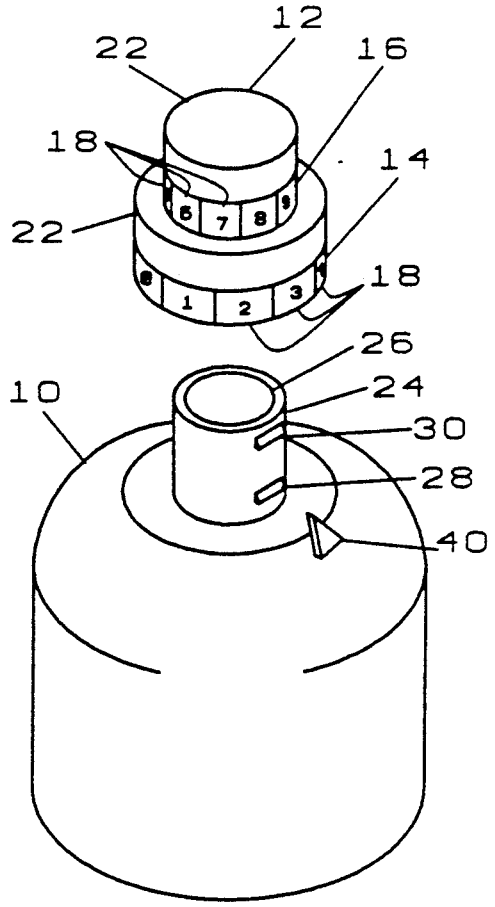
FIG. 2 is a view of the safety container of FIG. 1, showing the cap removed from the container.
Figure 3:
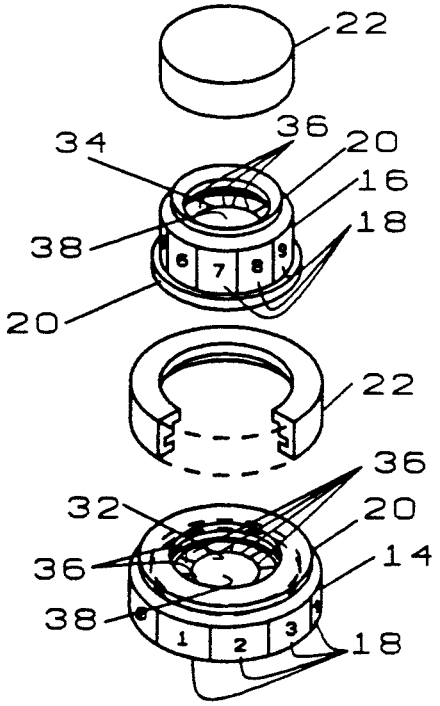
FIG. 3 is an exploded view of the cap of the safety container of FIG. 1.
Figure 4:
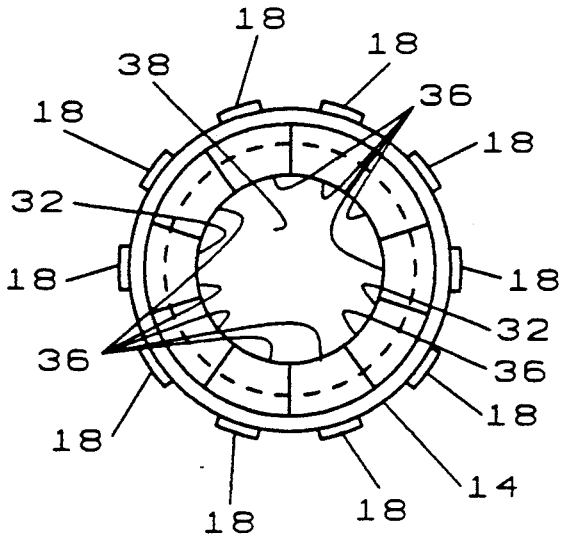
FIG. 4 is a plan view of one of the annular bands of the cap of FIG. 1.

In that form of the present invention chosen for purposes of illustration in FIGS. 1-3, a safety container 10 has a cap 12 having a plurality of annular bands 14 and 16 which are rotatably mounted on the cap 12 and which each carry a plurality of indicia, such as numbers 18, disposed about the outer periphery of the annular bands 14 and 16. As best seen in FIG. 3, annular band 14 is formed with a generally C-shaped ring 20 facing outwardly about the upper edge of the band 14, while annular band 16 has C-shaped rings 20 extending about both the upper and lower edges of the annular band 16. The C-shaped rings 20 mate with inwardly facing C-shaped ring 22 which serve to connect the annular bands 14 and 16 to each other and to a suitable closure member 20, which has an inwardly facing C-shaped ring, not shown, extending about its lower edge for mating with the outwardly facing C-shaped ring 20 of annular band 16. The container 10 has a neck 24 formed with a central opening 26 which communicates with the interior of the container 10 and allows insertion and removal of the contents of the container 10. As best seen in FIGS. 1 and 2, the neck 24 has a plurality of flanges 28 and 30 projecting outwardly from the neck 24. The radius of the flanges 28 and 30 is slightly less than the interior radius of the annular bands 14 and 16 and flange 28 is positioned slightly above annular band 14, while flange 30 is positioned slightly above annular band 16 and is in vertical alignment with flange 28. As best seen in FIGS. 3 and 4, the annular bands 14 and 16 are each formed with interior flanges 32 and 34, which are divided into a plurality of wedge-shaped segments 36, which are formed of frangible material or are otherwise selectably removable, and which correspond in number and position to respective ones of the indicia 18 which are disposed about the exterior of the annular bands 14 and 16. If desired, a central opening 38 may be provided. Finally, an indexing mark 40 is provided on the exterior of the container 10 in a position to lie adjacent the lower edge of the cap 12 and in alignment with the flanges 28 and 30, when the cap 12 is mounted on the neck 24 of the container 10. Although FIGS. 1-3 3 show the cap 12 as having two annular bands 14 and 16, it will be apparent that the number of annular bands and corresponding flanges 28 and 30 may be varied substantially as desired.

In use, the manufacturer may choose to pre-set access combinations for certain products. Accordingly, the container 10 may, if desired, be sold with opening 26 of the neck 24 covered by a suitable seal, not shown, and the cap 12 will be provided together with, or as an optional addition to, the container 10. The cap 12 cannot be mounted on neck 24 of the container 10, since the wedge-shaped segments 36 projecting inwardly from the annular bands 14 and 16 will block passage of the flanges 28 and 30 on the exterior of the neck 24 of the container 10. However, by selectively removing one of the segments 36 from annular band 14 and removing another of the segments 36 from annular band 16, the authorized user can set their own personal security code for the cap 12. Having removed the appropriate segments 36, the authorized user twists the annular bands 14 and 16 of the cap 12 to align the selected indicia 18 with the index mark 40 to allow the outwardly-projecting flanges 28 and 30 to pass through the spaces in the inwardly-projecting flanges 32 of the annular bands 14 and 16 which correspond to the removed segments 36 and, hence, to cause the cap 12 to releasably close the neck 24 of the container 10. Then, the authorized user gives the bands 14 and 16 a spin to be sure that the spaces corresponding to the removed segments 36 are no longer aligned with the index mark 40. Once this has been done, the cap 12 cannot be removed by unauthorized persons, because any attempt to remove the cap 12 will cause the flanges 28 and 30 to strike against the remaining segments 36 of the annular bands 14 and 16 and to prevent removal of the cap 12. However, when the authorized user desires to remove the cap 12, they simply rotate the annular bands 14 and 16 until the indicia 18, which correspond to the locations of the removed segments 36, are aligned with the index mark 40. When this has been done, the authorized user can lift the cap 12, causing the outwardly-projecting flanges 28 and 30 on neck 24 of the container to pass freely through the spaces from which the segments 36 have been removed and, hence, allowing the cap 12 to be removed from the container 10.

Figure 6:
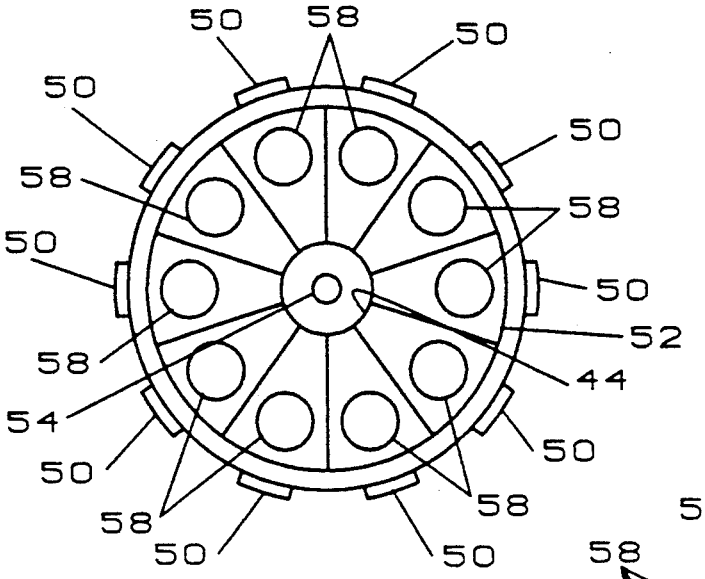
FIG. 6 is a plan view of an alternative form of the annular bands of the cap of FIG. 1 for use with the safety container of FIG. 5.
Figure 7:
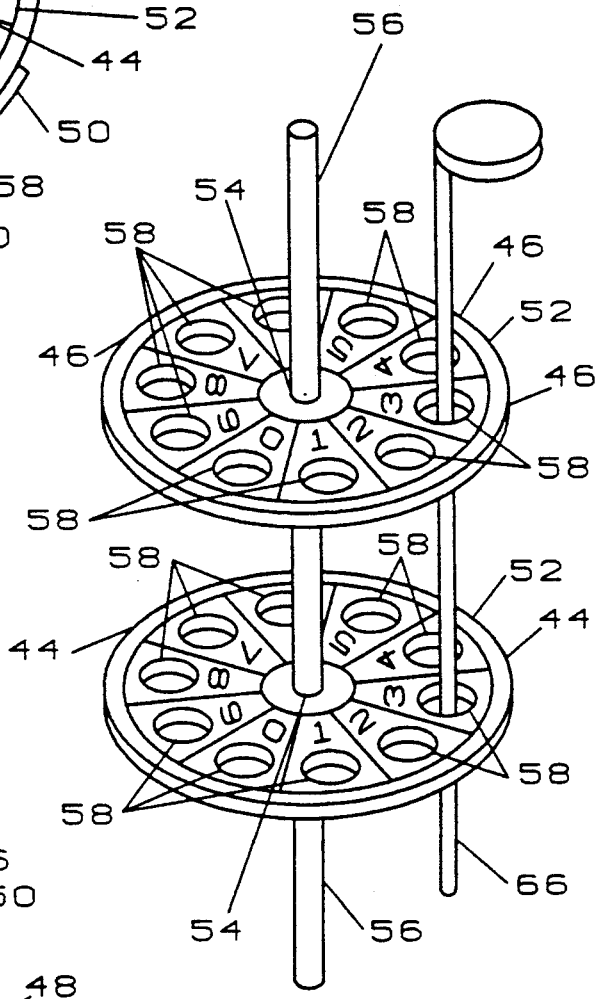
FIG. 7 is a diagrammatic representation showing means for programming a cap embodying the annular bands of FIG. 4.
Figure 5:
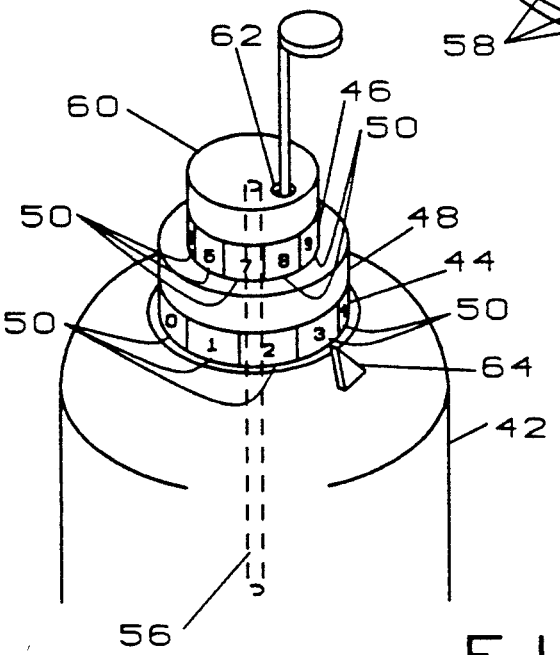
FIG. 5 is a partial side view of a safety container, embodying the present invention, for dispensing liquids.

FIGS. 5, 6 and 7 show a safety container 42, for storing and dispensing liquids, having a plurality of annular bands 44 and 46 which are rotatably mounted about the neck 48 of the container 42 and which each carry a plurality of indicia, such as numbers 50, disposed about the outer periphery of the annular bands 44 and 46. As best seen in FIG. 6, the annular bands 44 and 46 each extend about the periphery of discs 52, which are each formed with a central opening 54 and which are rotatably mounted on a central shaft 56 which, preferably, extends axially completely through the container 42. Each of the discs 52 serves to prevent passage of liquid from within the container 42, but has a plurality of removable circular regions 58 disposed about the disc 52 in positions corresponding to the locations of the indicia 50 on the exterior of the annular bands 44 and 46. The cap 60 of the container 42 serves to close the upper end of the container 42 and is formed with an opening 62 extending therethrough. Finally, an index mark 64 is provided on the exterior of the container 42 adjacent the annular bands 44 and 46 and in vertical alignment with the opening 62 of the cap 60.

In use, when the container 42 is sold, none of the circular regions 58 will have been removed. Thus, the discs 52 will be solid and will prevent liquid within the container 42 from reaching the opening 62. Consequently, no liquid can be dispensed from within the container 42. However, the authorized user can rotate the annular bands 44 and 46 to align desired ones of the indicia 50 with the index mark 64 on the container 42 and, hence, with the opening 62 in the cap 60, and can then insert a rigid shaft 66 through opening 62 to punch out or remove selected ones of the regions 58 from the discs 52, which correspond to the selected indicia 50 on the annular bands 44 and 46. With the selected regions 58 removed from the discs 52, liquid from within the container 42 can flow through the removed regions 58 and through opening 62 to be dispensed. Subsequently, by spinning the annular bands 44 and 46, the removed regions 58 can be moved out of alignment with opening 62 to prevent inadvertent or unauthorized dispensing of liquid from within the container 42.

Obviously, numerous variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A safety container comprising:

a container having a neck, closure means for said neck having a plurality of annular bands rotatably mounted on said closure means, each of said bands being formed with a plurality of elements which are selectably removable for programming said closure means and which must be positioned in a selected manner in order to gain access to the contents of said container, and an index mark carried by said container for indicating when the selected elements are aligned in said selected manner.

2. The safety container of claim 1 wherein:

said bands carry a plurality of indicia spaced about the exterior thereof, and said elements project inwardly from said bands and each of said elements corresponds in rotational position with a respective one of the indicia carried by said bands.

3. The safety container of claim 1 further comprising:

a plurality of flanges projecting outwardly from said neck in spaced vertical alignment and in alignment with said index mark and engageable by unremoved ones of said elements to prevent unauthorized access to the contents of said container.

4. The safety container of claim 1 wherein:

said closure means is a cap removably securable to close said neck.

5. The safety container of claim 1 further comprising:

a shaft extending axially within said container and rotatably supporting said annular bands.

6. The safety container of claim 1 further comprising:

an opening in said closure located in vertical alignment with said index mark, and a plurality of discs each carrying said annular bands and serving to prevent passage of fluid from within said container except through an area where a selected one of said elements has been removed.

* * * * *